United States Patent [19]

Hurst

[11] 4,270,435

[45] Jun. 2, 1981

[54] DESENSITIZED PRIMARY EXPLOSIVES

[75] Inventor: Gerald L. Hurst, Austin, Tex.

[73] Assignee: Atlas Powder Company, Dallas, Tex.

[21] Appl. No.: 39,351

[22] Filed: May 16, 1979

[51] Int. Cl.[3] ..... C06B 37/00; F42B 3/10

[52] U.S. Cl. ..... 86/1 R; 86/20 R; 149/33; 423/42; 423/365

[58] Field of Search ..... 86/1 R, 20 R; 149/33; 423/42, 365

[56] References Cited

U.S. PATENT DOCUMENTS

| | | | |
|---|---|---|---|
| 56,167 | 7/1866 | Boldt | 149/33 |
| 2,067,213 | 1/1937 | Snelling | 149/33 X |

OTHER PUBLICATIONS

Urbanski, Chemistry and Technology of Explosives, vol. 3, Pergamon Press, New York, 1976, pp. 157 to 160.

*Primary Examiner*—Leland A. Sebastian

*Attorney, Agent, or Firm*—Richards, Harris & Medlock

[57] ABSTRACT

A method for manufacturing explosive articles which contain primary explosives and therefore present explosion hazards during conventional loading and packaging operations is disclosed which includes desensitizing the primary explosive such as silver fulminate, for example, by admixing therewith an effective amount of a desensitizing agent to form a resulting composition so as to render the primary explosive insensitive to shock, depositing the desensitized primary explosive on a substrate material, and thereafter, resensitizing the primary explosive by allowing decomposition of the resulting composition to thereby recapture the sensitivity of the primary explosive so deposited.

20 Claims, No Drawings

DESENSITIZED PRIMARY EXPLOSIVES

BACKGROUND OF THE INVENTION

In one aspect this invention relates to a method for reversibly desensitizing primary explosives so as to render them substantially incapable of detonation by shock or impact. Another aspect of this invention relates to a method for manufacturing explosive articles which contain primary explosives wherein the dangers normally attending the production of such articles due to shock sensitivity are substantially alleviated. In still a further aspect, the present invention relates to a method for packaging the explosive materials comprising primary explosives which provides for desensitization of the primary explosive in bulk quantities with the subsequent recapture of shock sensitivity when smaller discrete portions of the primary explosive have been packaged.

The term "primary explosive" as used herein refers to shock sensitive explosive compositions conventionally used as initial detonating agents for less sensitive explosive compositions. These primary explosives are more easily detonated by application of impact or friction than are non-impact sensitive explosives such as ammonium nitrate, TNT and cellulose nitrate, for example. Specifically, the method of the present invention is directed to the primary explosives such as silver fulminate (AgONC). Silver fulminate has been used in the past in the manufacture of fireworks and similar materials such as impact torpedo noisemakers. However, because of its high impact sensitivity, handling bulk quantities of silver fulminate has presented substantial explosion hazards in the past. One example of an application of silver fulminate is the pyrotechnic noisemaker set forth in U.S. Pat. No. 4,005,657 issued Feb. 1, 1977. The noisemaking device disclosed therein comprises a small amount of impact sensitive explosive particles produced from coating gravel or sand with silver fulminate employing a suitable adhesive such as a water soluble casein glue. While relatively small amounts of the explosive silver fulminate are present in each of the individual noisemaker devices, manufacturing such noisemakers on a commercial scale presents the problem of handling bulk quantities of silver fulminate. Thus, for example, if it is desired to produce explosive particles on a commercial scale comprising a silver fulminate admixture of sand, the handling of bulk quantities of silver fulminate will involve a fairly high degree of risk of accidental impact detonation of the explosive. Furthermore, while silver fulminate has the explosive properties necessary for use in commercial blasting caps and military munitions, the impact sensitivity of the material presents safety hazards which in most cases outweigh the desirability of employing this explosive in those types of operations.

Thus, a method by which silver fulminate could be desensitized while in a bulk quantity so as not to be subject to accidental impact detonation and then later resensitized to thereby recapture its excellent impact sensitivity and explosive properties once it has been packaged in smaller discrete quantities is desirable and would facilitate the use of silver fulminate in a wide variety of explosive applications.

SUMMARY OF THE INVENTION

I have discovered that an explosive metal fulminate such as silver fulminate can be desensitized by contacting it with a desensitizing agent selected from the group consisting of ammonia and certain amines in aqueous solution. The resulting silver fulminate compound is substantially insensitive to detonation by shock and may be processed by various methods in this insensitive condition without a high risk of impact detonation. Thus, a bulk quantity of silver fulminate can be deposited on various substrate materials and otherwise handled or packaged with relative safety. The resulting compound is unstable and will decompose, releasing, when ammonia is used as the desensitizing agent, gaseous ammonia and leaving resensitized silver fulminate after a period of time under normal conditions. However, in order to insure that the silver fulminate will regain its sensitivity a small amount of resensitizing agent in the form of an acid which will readily react with liberated gas and drive the equilibrium of the reaction in a manner favoring the release of ammonia from the silver fulminate is desirable. Thus, the discrete, desensitized portions of silver fulminate can be resensitized once the dangers attending accidental impact detonation of a bulk quantity of silver fulminate are no longer present.

DETAILED DESCRIPTION OF THE INVENTION

I have discovered that by employing certain types of desensitizing agents in a liquid or gaseous phase or combination thereof, silver fulminate can be made substantially insensitive to detonation by shock or impact. As used in this description, for purposes of the invention any reference to silver fulminate is to be taken as being applicable to other primary explosives that exhibit desensitizing characteristics similar to those of silver fulminate. Thus, bulk quantities of silver fulminate which have heretofore presented explosion hazards when handled on a commercial scale during loading and packaging operations, for example, can be desensitized according to the method of the present invention to alleviate those hazards and then resensitized in a manner which recaptures the desirable impact sensitivity and explosive characteristics of this primary explosive.

The desensitization can be accomplished by admixing silver fulminate with an aqueous solution of ammonia, certain amines or mixtures thereof to thereby form a resulting compound which is insensitive to shock or impact detonation. The desensitization of silver fulminate can be accomplished by contacting the explosive with desensitizing agents either in liquid or vapor form and can be accomplished by conventional methods of mixing, agitation, and tumbling action. Normally, contact time in a range of from about one minute to about one hour will be sufficient to insure desensitization of the silver fulminate. Preferably, the desensitization of the silver fulminate is incorporated in the manufacturing of silver fulminate from raw materials. For example, silver fulminate can be made by reacting approximately stoichiometric quantities of nitric acid, ethyl alcohol and silver, preferably with a slight excess of nitric acid and ethyl alcohol being present. The resulting reaction forms silver fulminate which is a white flocculent at about 80° C. Thereafter, most of the supernatant is removed and the white flocculent is water washed by multiple decantation. The desensitizing agent is gradually introduced into the wash water in amounts of less than about 1% by weight of desensitizing agent up to about 30% by weight of desensitizing agent. The desensitized product is formed during the multiple decantation of the white flocculent.

Although it is not necessary to understand the mechanism by which the silver fulminate is desensitized, it is theorized that a coordination compound is formed between the silver fulminate and the desensitizing agent, such as silver fulminate diammoniate when ammonia is used as the desensitizing agent, for example. The resulting coordination compound is substantially insensitive to detonation by shock or impact although it is unstable and will gradually decompose causing the silver fulminate to regain its shock sensitivity. This desensitization process allows for safer handling of bulk quantities of silver fulminate.

Because of silver fulminate's brisance in its normally sensitive state, usually only small quantities thereof will be employed in explosive devices such as capwells for munitions, blasting caps for the explosive industry, fireworks, noisemakers and the like. A desensitized quantity of silver fulminate can be deposited onto a substrate such as the interior of a capwell for munitions, the cylindrical tube of conventional blasting caps, while other substrate materials include, for example, granular earth materials such as sand or silica. Optionally, a suitable adhesive can be used to insure that the deposited silver fulminate explosive remains intact on the desired substrate surface. For example, in addition to being loaded into conventional types of explosive cartridges and the like by packaging equipment, the desensitized silver fulminate can be admixed with inorganic particulate matter such as sand or silica and bonded thereto using a suitable amount of an adhesive such as a water-soluble casein glue amount. Preferably, and as will be hereinafter described, no adhesive is used to coat particles with silver fulminate, since the adhesive tends to lower the amount of energy which can be released by the silver fulminate.

Once the ammonia desensitized silver fulminate is deposited on a suitable substrate or within the explosive article being manufactured, the desensitized silver fulminate can be reactivated to its initial level of sensitivity to impact detonation after placing the article in an enclosed container with an effective amount of a Lewis acid which will accelerate the rate at which ammonia is removed from the ammonia desensitized silver fulminate .

The resensitization process can be effected in a number of ways including bringing such a resensitizing agent into contact with the desensitized silver fulminate once it has been packaged in discrete portions. As previously described, the desensitized silver fulminate is an unstable compound and will slowly decompose leaving silver fulminate in a shock sensitive state. For example, the desensitized silver fulminate will regain its shock and impact sensitivity when maintained at ambient temperature after a period of from about 2 hours to about 3 days. This time can be reduced by mildly heating the desensitized silver fulminate. By effecting the resensitization after the bulk quantity of silver fulminate has been packaged or otherwise separated into discrete smaller portions, the risk of large catastrophic accidental explosions can be avoided. Thus, the step of recapturing the sensitivity of the silver fulminate can be accomplished by placing the explosive articles containing the desensitized silver fulminate in an acid environment, such as, for example, an enclosed chamber wherein a Lewis acid is present in a solid, liquid or gaseous state. In another embodiment, acids such as phosphoric acid can be added in relatively small amounts to the explosive article containing the desensitized silver fulminate to thereby reactivate it shortly before shipping.

According to the invention, the preferred desensitizing agent is ammonia. Ammonia may be used in either a gaseous or liquid form with an inert diluent. As previously described, preferably the ammonia is in an aqueous solution or in the gas phase when contacted with the silver fulminate. Other desensitizing agents that can be used in accordance with the invention include certain amine compounds such as pyridine or aniline. Other amines which are known to work include piperazine (diethylenediamine), n-ethyl piperazine and triethylamine. Any amine compound which will desensitize the silver fulminate by producing an unstable compound which liberates a gaseous product leaving behind the silver fulminate in an impact sensitive state can be used in accordance with the method of the present invention. Similarly, the amines are present in the gas phase or in an aqueous solution when contacting the silver fulminate or in any other inert liquid or gaseous diluent.

One use of the method of the present invention comprises the manufacture of toy noisemakers using silver fulminate. Thus, according to the steps outlined above, a bulk quantity of silver fulminate can be manufactured and washed with an aqueous ammonia solution, for example, as previously described and in sufficient quantities to effect the desensitization of the silver fulminate. The deactivated silver fulminate can then be tumbled with, for example, fine grain sand in sufficient quantities to substantially coat the sand. It is preferred, although not necessary, that the tumbling occurs in an ammonia vapor atmosphere. The sand and silver fulminate are tumbled until a uniform homogeneous mix is formed which appears dry, although some water will be present.

When coating sand with silver fulminate, the preferred weight ratio of silver fulminate to sand is between about 1:400 and 1:200. The preferred particle size for sand or any other type of particle that will be used, for example, in toy noisemakers, is from about 16 to 18 mesh. Other materials could be used and no specific shape or configuration of the particles is required. For example, any inert material which would not desensitize the silver fulminate could be used and the configuration of the particles could be, for example, spherical. As mentioned previously, it is preferred that no adhesive be used so that the full explosive force of the silver fulminate can be utilized, for example, in toy noisemakers, for maximum noise output.

To make a noisemaker, for example, the silver fulminate coated sand can then be wrapped in tissue paper or otherwise packaged with each discrete package containing from about 0.0005 to about 0.001 grams of silver fulminate on about 0.2 grams of sand and boxed in quantities of about 50 to a box containing about 5 grams of sawdust, for example. Before the noisemakers are utilized, the silver fulminate must be resensitized so that it is shock or impact sensitive. Since the desensitized compound is unstable, decomposition into shock sensitive silver fulminate will result. The resensitization process can be accelerated by mildly heating the desensitized silver fulminate or by maintaining a resensitizing agent, such as a Lewis acid, in the presence of the desensitized silver fulminate. For example, just before the package containing the quantity of noisemakers is sealed, two or three drops of phosphoric acid or some other Lewis acid is added to the sawdust and then the package is sealed. The presence of a Lewis acid will insure essentially complete and rapid desensitization of the coordination compound as any ammonia liberated by the decomposition of the coordination compound will react with the acid to form, when phosphoric acid is used for example, ammonium dihydrogen phosphate. By the time the package is opened and the products are sold commercially, the acid will have reacted with the liberated ammonia to drive the equilibrium of the reaction in which decomposition of the coordination compound occurs in the direction of decomposition (formation of ammonia and silver fulminate) to completely free the silver fulminate of the ammonia as follows, thereby reactivating the silver fulminate:

Silver fulminate diammoniate→Silver fulminate+Ammonia (1)

Ammonia+Phosphoric Acid→Ammonium dihydrogen phosphate. (2)

Thus, the package contained in the noisemakers in effect becomes reactivated as it sits on the shelf. It is to be understood that silver fulminate used for other applications and desensitized in accordance with the invention can be similarly resensitized as previously described herein.

This invention has been described with respect to the preferred embodiments thereof. However, modifications and adaptations will now be apparent to one skilled in the art upon reading the subject specification. All such modifications and adaptations which fall within the scope of the appended claims are intended to be covered thereby.

I claim:

1. A method of desensitizing and resensitizing explosive metal fulminate primary explosives comprising:
   (a) contacting the explosive metal fulminate with an effective amount of desensitizing agent selected from the group consisting of aliphatic amines, aromatic amines and ammonia to desensitize the explosive metal fulminate; and
   (b) subsequently contacting the explosive metal fulminate with a Lewis acid in an amount effective to thereby recapture the impact sensitivity of the explosive metal fulminate.

2. The method as recited in claim 1 wherein the explosive metal fulminate is silver fulminate and said method is used for manufacturing explosive articles containing silver fulminate as a primary explosive.

3. The method as recited in claim 2 further comprising depositing said desensitized primary explosive on substrate material.

4. In a method of manufacturing explosive articles containing primary explosives the improvement comprising:
   depositing silver fulminate on a substrate surface in a desensitized condition, said desensitized condition being effected by first admixing said silver fulminate with an effective amount of a desensitizing agent selected from the group consisting of aliphatic amines, aromatic amines, and ammonia.

5. A method for packaging silver fulminate containing explosive articles wherein the danger of shock detonation of a bulk quantity of said silver fulminate is substantially eliminated, comprising:
   (a) desensitizing a bulk quantity of silver fulminate by contacting said silver fulminate with an effective amount of a desensitizing agent selected from the group consisting of aliphatic amines, aromatic amines and ammonia;
   (b) depositing said desensitized silver fulminate on a substrate material;
   (c) packaging discrete portions of said substrate deposited bulk quantities of desensitized silver fulminate;
   (d) resensitizing said packaged discrete portions of silver fulminate by contacting said silver fulminate with an effective amount of a resensitizing agent.

6. The method as recited in claim 5 wherein said resensitizing agent is a Lewis acid.

7. A method of desensitizing and resensitizing silver fulminate comprising contacting said silver fulminate to form a resulting composition with a desensitizing composition comprising a mixture of at least one compound selected from the group consisting of ammonia and amine compounds and an inert diluent therefor in a concentration and amount sufficient to eliminate the impact sensitivity of said silver fulminate but which resulting composition decomposes to liberate in gaseous form at least part of said desensitizing composition to resensitize said silver fulminate.

8. The method as recited in claim 7 wherein the decomposition of said resulting composition is accelerated by causing a Lewis acid to react with the gas liberated by said resulting composition.

9. The method as recited in claim 7 wherein the decomposition of said resulting composition is accelerated by mildly heating said resulting composition.

10. The method as recited in claim 7 wherein the inert diluent is water.

11. The method as recited in claim 6 wherein the concentration of compounds selected from the group consisting of ammonia and amine compounds are present in an amount of from about 0.5% to 100% by weight of the total desensitizing composition.

12. The method as recited in claim 7, 10 or 11 wherein said desensitizing agent is present in gaseous form.

13. The method as recited in claim 7 or 11 wherein said desensitizing agent is present in liquid form.

14. The method as recited in claim 7, 10 or 11 wherein said desensitizing agent is present in both liquid and gaseous phases.

15. A method of manufacturing silver fulminate comprising:
   (a) reacting approximately stoichiometric quantities of nitric acid, ethyl alcohol and silver to form a silver fulminate flocculent;
   (b) separating the majority of the supernatent from the silver fulminate flocculent;
   (c) washing the flocculent silver fulminate with water to remove the remainder of the supernatent;
   (d) desensitizing the silver fulminate after water washing by contacting the silver fulminate with a desensitizing composition comprising a mixture of at least one compound selected from the group consisting of ammonia and amine compounds and an inert diluent therefor in a concentration and amount sufficient to form a resulting compound which has low impact sensitivity relative to the impact sensitivity of silver fulminate but which resulting composition decomposes to liberate in gaseous form at least part of said desensitizing composition to provide impact sensitive silver fulminate.

16. The method as recited in claim 15 wherein said desensitizing composition includes from about 0.5% to about 100% ammonia by weight of said total desensitizing composition.

17. The method as recited in claim 15 or 16 wherein said desensitizing agent is present in gaseous form.

18. The method as recited in claim 15 or 16 wherein said desensitizing agent is present in liquid form.

19. The method as recited in claim 16 wherein said silver fulminate is contacted, after water washing, with desensitizing compositions of increasing concentrations of ammonia, beginning with an aqueous composition having an ammonia concentration of about 1% by weight and ending with an aqeuous composition having an ammonia concentration of about 30% by weight.

20. The method as recited in claim 15 further comprising:

depositing said desensitized silver fulminate upon a substrate; and subsequently resensitizing said silver fulminate by maintaining said desensitized silver fulminate in the presence of a Lewis acid.

* * * * *